US007201666B1

(12) United States Patent
Chan

(10) Patent No.: US 7,201,666 B1
(45) Date of Patent: Apr. 10, 2007

(54) COMBINATION CONSTRUCTION FOR TIP AND POINT FERRULE OF BILLIARD CUE

(75) Inventor: Richard Chan, Richmond (CA)

(73) Assignee: Jennifer Chen, Taipei (TW)

( * ) Notice: Subject to any disclaimer, the term of this patent is extended or adjusted under 35 U.S.C. 154(b) by 0 days.

(21) Appl. No.: 11/251,827

(22) Filed: Oct. 18, 2005

(30) Foreign Application Priority Data

Sep. 20, 2005 (TW) ..... 94216190 U

(51) Int. Cl.
*A63D 15/12* (2006.01)

(52) U.S. Cl. ..... 473/51

(58) Field of Classification Search ..... 473/49–51
See application file for complete search history.

(56) References Cited

U.S. PATENT DOCUMENTS 5,016,877 A * 5/1991 Lowery ..... 473/51
5,462,490 A 10/1995 Donwen
5,938,536 A * 8/1999 Minke ..... 473/49
6,251,024 B1 * 6/2001 Summers et al. ..... 473/49
2003/0166419 A1 * 9/2003 Gulyassy ..... 473/44

* cited by examiner

*Primary Examiner*—Mark S. Graham
(74) *Attorney, Agent, or Firm*—Bacon & Thomas, PLLC

(57) ABSTRACT

A combination construction for a tip and point ferrule of a billiard cue. The tip is manufactured from an epoxy resin reinforced glass fiber material that is used in the manufacturing of printed circuit boards. The material is formed into a rivet (mushroom) shape to allow the outer most part of the shaft that is shaped into a small cylindrical shaped object to be inserted into the cavity of a bush shaped point ferrule in order to connect with the small cylindrical object beneath the tip, and to allow the compression packing located between the tip and point ferrule to absorb the counter force of striking a billiard ball such that the tip and point ferrule are not damaged during impact.

3 Claims, 2 Drawing Sheets

COMBINATION CONSTRUCTION FOR TIP AND POINT FERRULE OF BILLIARD CUE

BACKGROUND OF THE INVENTION

1. Field of the Invention

This invention relates to a combination construction for a tip and point ferrule of a billiard cue, more particularly to a billiard cue having an assembly for a tip and point ferrule manufactured from epoxy resin reinforced glass fiber material in such a way as to be easily glued to the shaft without coming off.

2. Prior Art

A conventional billiard cue such as a break cue and a jump cue are specified to be 1.4 meters in length and 600 grams in weight. The cue's construction can be divided into tip-point ferrule-shaft-joint-butt hilt-cushion in order from the tip side. In this invention, a tip and point ferrule in combination are described as a combination construction for a tip and point ferrule of a billiard cue. The tip of this combination construction is usually made of buffalo leather, rubber, or phenolic resin, and if used as the tip of a breaking cue, it is found that the strength of the tip is not sufficient to resist deformation. Meanwhile, a tip made of buffalo leather and rubber has a high water absorbance, and will cause insufficient chalk adherence onto the cue tip when applying chalk, thus transferring insufficient momentum and losing precision when hitting the billiard ball.

The conventional billiard cue is comprised of a shaft, a butt hilt and a joint for combining the shaft and the butt hilt, wherein the joint can be formed by a screw like protrusion located at the front end of the butt hilt and screwed into a nut located at the rear end of the shaft to combine into the billiard cue, while the tip (tip pad and tip insert) and point ferrule are fixed (screwed or glued) at the front end of the shaft, and a compression packing is located between the tip and point ferrule and is used to absorb the counter force of striking the billiard ball so that the tip and point ferrule are not damaged during breaking or hitting. The outer most part of the shaft is shaped into a small cylindrical shaped object to be inserted into the cavity of a bush shaped point ferrule in order to connect the small cylindrical object beneath the tip. There are some troubles that occur, such as separation, breakage, and crack formation in the tip, point ferrule and compression packing due to inadequate materials (high moisture content, low strength) and fixation methods. Similar known billiard cues having improved tip configurations are disclosed in U.S. Pat. No. 5,462,490.

There has been a long felt need by persons skilled in the art of billiard manufacturing for adopting an appropriate material to make a billiard cue having sufficient strength not to deform when breaking the billiard ball and low water absorbance in the tip to allow sufficient chalk to be adhered thereon.

SUMMARY OF THE INVENTION

In viewing of the foregoing problems, it has been determined that epoxy resin reinforced glass fiber material used in the manufacturing of printed circuit boards and having strength characteristics such as an Izod impact strength 2~3 times greater than those of phenolic resin reinforced materials (for example, paper sheet, cotton cloth, and linen) is preferred to form the tip in a rivet (mushroom) shape in order to be easily adhered to the point ferrule in a combination. Said combination construction for the tip and point ferrule of the billiard cue made in this manner has sufficient strength not to be deformed when the combination is used in breaking the billiard ball, and chalk can be fully covered and sufficiently adhered to the tip due to the low water absorbance of the combination construction for the tip and point ferrule of the billiard cue. Additionally, sufficient momentum can be fully transferred to the billiard ball when it is hit, without losing precision.

In general, the billiard cue tip is comprised of a tip and point ferrule, while there is also a compression packing between the tip and point ferrule designed to absorb the counter force of striking the billiard ball and subjected to the tip, the tip having an undercut head in the shape of flat disc so as not to damage the bush shaped point ferrule of plastic material during impact. The outer most part of the shaft is shaped into a small cylindrical shaped object to allow this small cylindrical shaped object to be inserted into the cavity of the bush shaped point ferrule.

The manner of the combination construction (assembly) for the tip and point ferrule of the billiard cue described in connection with the drawings will be explained particularly with reference to the illustrated figures in FIG. 2~FIG. 4.

In one embodiment of the combination construction for the tip and point ferrule of the billiard cue in this invention, the tip is manufactured from an epoxy resin reinforced glass fiber material that is used in the manufacturing of printed circuit boards. The material is formed into a rivet (mushroom) shape to allow the outer most part of the shaft that is shaped into a small cylindrical shaped object to be inserted into the cavity of the bush shaped point ferrule to connect the small cylindrical shaped object beneath the tip, to allow the compression packing located between the tip and point ferrule to absorb the counter force of striking the billiard ball such that the tip and point ferrule are not damaged during impact.

The tip has an undercut head in the shape of a flat disc with a small cylindrical object beneath the tip forming a rivet (mushroom) shape, wherein the flat disc is about 12.75~13.3 mm, preferably 13.00 mm in diameter, and about 5~8 mm in thickness, while the small cylindrical object beneath the tip is about 6~7 mm in length. The bush shaped point ferrule of plastic material is about 19 mm in height to allow the small cylindrical object beneath the tip and the small cylindrical shaped object of the outer most part of the shaft to be capped therein and inserted into the cavity of the bush shaped point ferrule. A compression packing may not be needed between the tip and point ferrule.

In another embodiment of the combination construction for the tip and point ferrule of the billiard cue of this invention, the tip is manufactured from an epoxy resin reinforced glass fiber material used in the manufacturing of printed circuit boards. The material is formed into a flat disc shape having an undercut head. The flat disc is about 12.75~13.3 mm, and preferably 13.00 mm in diameter, and about 5~8 mm in thickness.

In another embodiment of the combination construction for the tip and point ferrule of the billiard cue of this invention, the tip and point ferrule of the billiard cue is manufactured from an epoxy resin reinforced glass fiber material used in the manufacturing of printed circuit boards and is integrally formed to define a cylindrical object of about 21~22 mm in height, and about 12.75~13.3 mm, preferably 13.00 mm in diameter and having an undercut head with a small cylindrical cavity of about 12~13 mm in length dug (drilled or formed) inside the center of the lower portion of the cylindrical object, to be matched directly with the small cylindrical shaped object, having a length about 12~13 mm, of the outer most part of the shaft.

The tip used, which is manufactured from epoxy resin reinforced glass fiber material, of the combination construction for the tip and point ferrule of the billiard cue of this invention, is preferably of NEMA (National Electrical Manufacturers Association) grade F4, for example epoxy resin reinforced glass fiber material in the trade name of Gerolite-10, which possesses an Izod impact strength of about 7 ft-lb/inch (ASTM-D256), which is 2~3 times greater than those of conventional phenolic resin reinforced materials (for example, paper sheet (4 ft-lb/inch), cotton cloth (3 ft-lb/inch), and linen (2.2 ft-lb/inch)) and a compression strength of about 60,000 PSI (ASTM-D695), which is about 1.6 times greater that those of conventional phenolic resin reinforced materials (for example, paper sheet (36,000 PSI), cotton cloth (37,000 PSI), and linen (37,000 PSI)), therefore no deformation of the tip manufactured from the epoxy resin reinforced glass fiber material will occur, and the material endures impact forces when breaking or striking the billiard ball.

Besides the high impact strength of the epoxy resin reinforced glass fiber material adopted as the material used for the tip of the combination construction for the tip and point ferrule of the billiard cue of this invention being high enough not to be deformed when breaking or striking the billiard ball, there is another reason to use the glass fiber material itself, which is a homologue of ceramic having a relatively low water absorbance (0.10% 24 hr, ASTM-D570) and is compatible with the calcium carbonate material of the chalk used in the billiard game. Thus, chalk can be fully covered and sufficiently adhered to the tip due to the low water absorbance of the combination construction for the tip and point ferrule of the billiard cue, therefore sufficient momentum can be fully transferred to the billiard ball when it is hit without losing precision. If the chalk is applied onto the conventional tip made of buffalo leather and rubber having high water absorbance itself, part of the chalk will not adhereand thus will not transfer enough momentum and the momentum remains along another vector for hitting the gravity center of the billiard ball, thus losing precision when hitting the billiard ball.

DESCRIPTION OF THE PREFERRED EMBODIMENT

With those and other objects in view, the invention consists in the construction hereinafter fully described, illustrated in the accompanying drawings, and set forth in the claims hereto appended, it being understood that various changes in size, shape, material, and minor details of construction, within the scope of the claims, may be resorted to without departing from the spirit of the invention or sacrificing any of the advantages thereof.

Example 1

Figure 1:
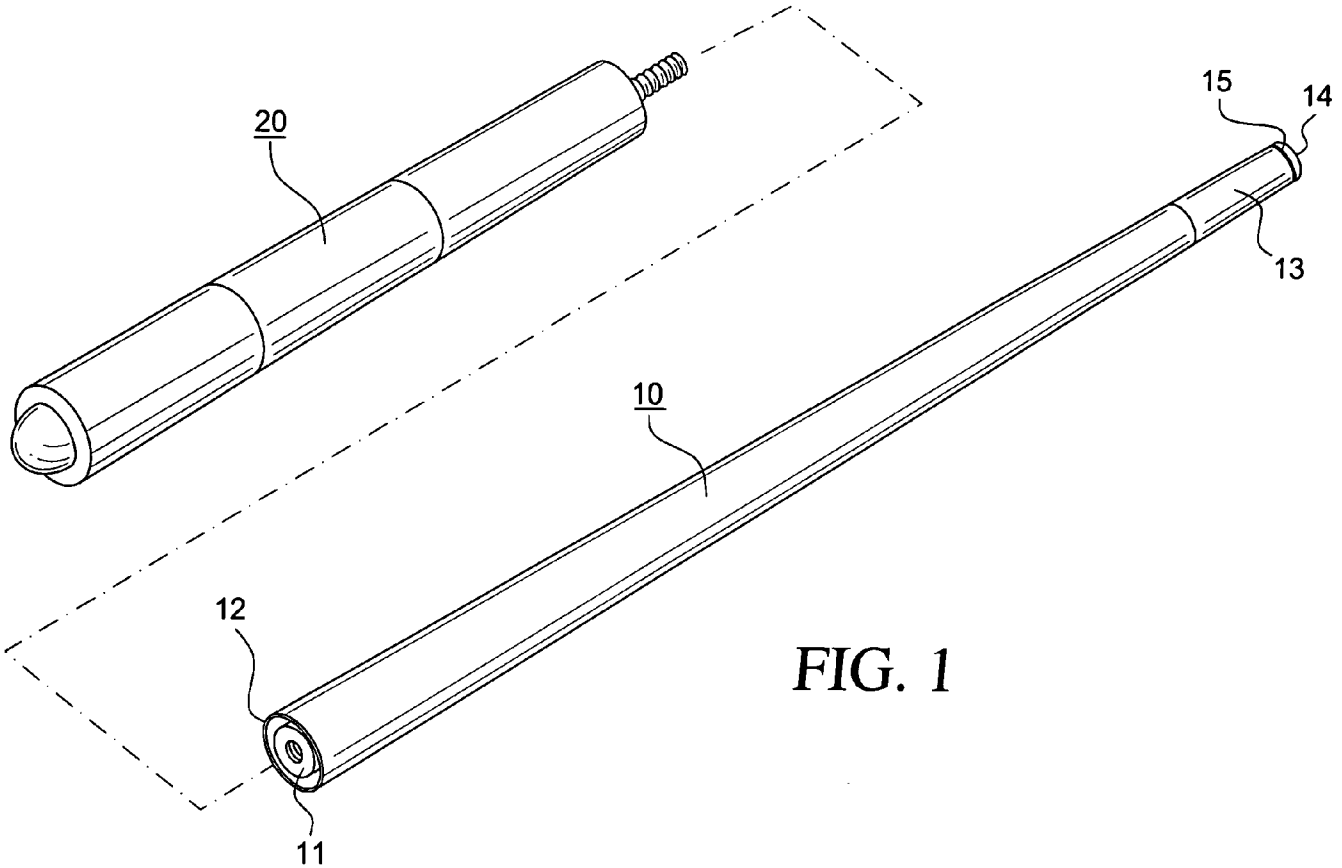
FIG. 1 is an exploded view of a conventional billiard cue.

A conventional billiard cue is comprised of a shaft 10, a butt hilt 20 and a joint 12 for combining the shaft 10 and the butt hilt 20, wherein the joint 12 can be formed by a screw like protrusion (numeral not shown) located at the front end of the butt hilt 20 and screwed into the nut 11 located at the rear end of the shaft 10 to combine into the billiard cue, while the tip 14 and point ferrule 13 are located at the front end of the shaft 10, and the compression packing 15 is located between the tip 14 and the point ferrule 13. The outer most part of the shaft 10 is shaped into a small cylindrical shaped object to be inserted into the cavity of bush shaped point ferrule 13 to connect the small cylindrical object beneath the tip 14 (Refer to FIG. 1).

Figure 2:
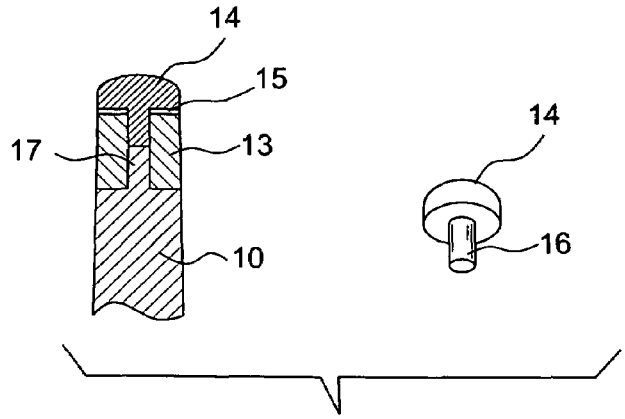
FIG. 2 illustrates an exemplary embodiment of a billiard cue having an assembly for the tip and point ferrule of this invention.

Referring to FIG. 2, an assembly (combination construction) for the tip and point ferrule of a billiard cue of this invention is shown as follows.

Tip 14 is manufactured from an epoxy resin reinforced glass fiber material commercially available from NEMA (National Electrical Manufacturers Association) grade F4, tradename Gerolite-10, and used in the manufacturing of printed circuit boards. The material is formed into rivet (mushroom) shape to allow the outer most part of the shaft 10, which is shaped into a small cylindrical shaped object 17 to be inserted into the cavity of a bush shaped point ferrule 13 to connect the small cylindrical object 16 beneath the tip 14, compression packing 15 is located between the tip 14 and the point ferrule 13 to absorb the counter force of striking the billiard ball such that the tip 14 and the point ferrule 13 are not damaged during impact (breaking or hitting).

The tip 14 has an undercut head in the shape of a flat disc and a small cylindrical object 16 is located beneath the tip forming a rivet (mushroom) shape, wherein the flat disc is about 12.75~13.3 mm, and preferably 13.00 mm in diameter, and about 5~8 mm in thickness, while the small cylindrical object beneath the tip is about 6~7 mm in length. The bush shaped point ferrule of plastic material is about 19 mm in height to allow the small cylindrical object beneath the tip and the small cylindrical shaped object of the outer most part of the shaft to be capped therein and inserted into the cavity of the bush shaped point ferrule. A compression packing may not be needed between the tip and point ferrule.

Example 2

Figure 3:
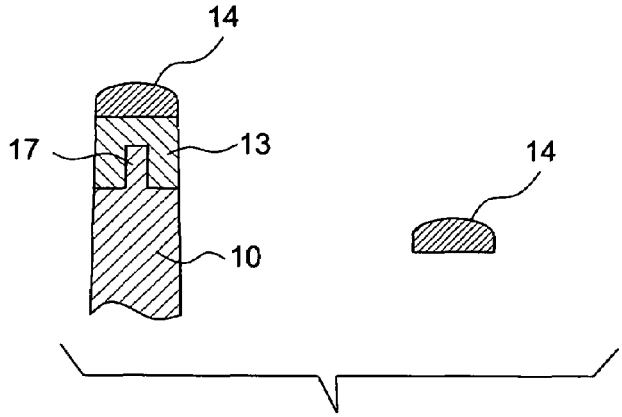
FIG. 3 illustrates another exemplary embodiment of a billiard cue having an assembly for the tip and point ferrule of this invention.

Referring to FIG. 3, another assembly (combination construction) for the tip and point ferrule of a billiard cue of this invention is shown as follows.

Tip 14 is manufactured from an epoxy resin reinforced glass fiber material commercially available from NEMA (National Electrical Manufacturers Association) grade F4, tradename Gerolite-10, and used in the manufacturing of printed circuit boards. The material is formed into a flat disc shape having an undercut head. The flat disc is about 12.75~13.3 mm, and preferably 13.00 mm in diameter, and about 5~8 mm in thickness.

The tip 14 having the undercut head in the shape of a flat disc is directly adhered onto a bush shaped point ferrule 13 in its entirety by adhesive. The bush shaped point ferrule of plastic material is about 19 mm in height to allow the small cylindrical shaped object 17 of the outer most part of the shaft 10 to be capped therein and inserted into the cavity of the bush shaped point ferrule 13 and firmly adhered by adhesive.

Example 3

Figure 4:
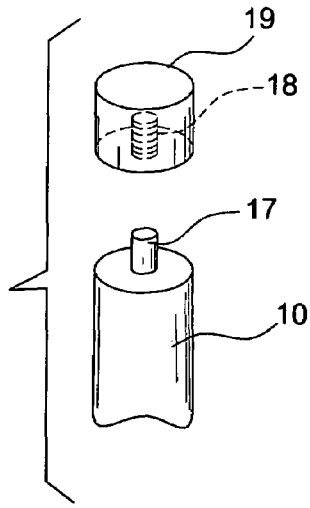
FIG. 4 illustrates further another exemplary embodiment of a billiard cue having an assembly for the tip and point ferrule of this invention.

Referring to FIG. 4, another assembly (combination construction) for the tip and point ferrule of a billiard cue of this invention is shown as follows.

The tip and point ferrule of a billiard cue are manufactured from an epoxy resin reinforced glass fiber material commercially available from NEMA grade F4, tradename Gerolite-10, and used in the manufacturing of printed circuit boards. The material is integrally formed to define a cylindrical object 19 of about 21~22 mm in height, and about 12.75~13.3 mm, preferably 13.00 mm in diameter and having an undercut head with a small cylindrical cavity 18 of about 12~13 mm in length dug (drilled or formed) inside the center of a lower portion of the cylindrical object 19, to be matched directly with the small cylindrical shaped object 17, about 12~13 mm in length, of the outer most part of the shaft 10 and firmly adhered thereto by adhesive.

Advantageous Effect of this Invention

The tip and/or point ferrule used, which is manufactured from an epoxy resin reinforced glass fiber material, for the combination construction for the tip and point ferrule of the billiard cue of this invention, is preferably of NEMA grade F4, for example epoxy resin reinforced glass fiber material in the trade name of Gerolite-10, which possesses an Izod impact strength of about 7 ft-lb/inch (ASTM-D256) that is 2–3 times greater than those of conventional phenolic resin reinforced materials (for example, paper sheet (4 ft-lb/inch), cotton cloth (3 ft-lb/inch), and linen (2.2 ft-lb/inch)) and having a compression strength of about 60,000 PSI (ASTM-D695), which is about 1.6 times greater that those of conventional phenolic resin reinforced materials (for example, paper sheet (36,000 PSI), cotton cloth (37,000 PSI) and linen (37,000 PSI)), therefore no deformation of the tip and/or point ferrule manufactured from the epoxy resin reinforced glass fiber material will occur, and the material endures impact forces when breaking or striking the billiard ball. The epoxy resin reinforced glass fiber material of the combination construction for the tip and point ferrule of the billiard cue of this invention has a relatively low water absorbance (0.10% 24 hr, ASTM-D570). Thus, chalk can be fully covered and sufficiently adhered to the tip due to the low water absorbance of the combination construction for the tip and point ferrule of the billiard cue, therefore sufficient momentum can be fully transferred to the billiard ball when it is hit without losing precision.

What is claimed is:

1. A combination construction for a tip and point ferrule of a billiard cue, comprising;

a tip, having a small cylindrical shaped object beneath said tip, and a bush shaped point ferrule, formed of plastic, both located at the front end of a shaft;

compression packing located between the tip and the bush shaped point ferrule;

the tip formed from a grade F4 epoxy resin reinforced glass fiber material commercially available from NEMA (National Electrical Manufacturers Association) into a rivet or mushroom shape to allow an outer most part of the shaft that is shaped into a small cylindrical shaped object to be inserted into a cavity of the bush shaped point ferrule to connect the small cylindrical object beneath the tip, the compression packing being located between the tip and the bush shaped point ferrule to absorb the counter force of striking a billiard ball that is subjected to the tip and bush shaped point ferrule so as not to damage the tip and bush shaped point ferrule;

said tip having an undercut head in the shape of a flat disc and the small cylindrical object beneath said tip to defining a rivet or mushroom shape, wherein the flat disc is about 12.75~13.3 mm in diameter, and about 5~8 mm in thickness, while said small cylindrical object beneath said tip is about 6~7 mm in length; and wherein said bush shaped point ferrule of plastic material is of about 19 mm in height to allow said small cylindrical object beneath said tip and said small cylindrical shaped object of the outer most part of said shaft to be capped therein and inserted into said cavity of the blush shaped point ferrule.

2. A combination construction for a tip and point ferrule of a billiard cue, comprising;

a tip formed from a grade F4 epoxy resin reinforced glass fiber material commercially available from NEMA (National Electrical Manufacturers Association) and having an undercut head in the shape of a flat disc having a diameter of about 12.75 to 13.3 millimeters and a thickness of about 5 to 8 millimeters;

and a bush shaped point ferrule formed from plastic material and including a cavity therein;

said tip and point ferrule both located at the front end of a shaft that includes a small cylindrical shaped object formed by the outer most part of said shaft; and said tip having an undercut head in the shape of flat disc being directly adhered onto the bush shaped point ferrule over the entirety of the undercut head by adhesive;

wherein said bush shaped point ferrule of plastic material is about 19 mm in height to allow the small cylindrical shaped object of the outer most part of said shaft to be capped therein and inserted into the cavity of the bush shaped point ferrule and firmly adhered therein by adhesive.

3. A combination construction for an integral tip and point ferrule of a billiard cue comprising:

a tip and point ferrule located at the front end of a shaft having a small cylindrical shaped object of about 12~13 mm in length formed from the outer most part of the shaft, said tip and point ferule integrally formed from a grade F4 epoxy resin reinforced glass fiber material commercially available from NEMA (National Electrical Manufacturers Association) to define a cylindrical object of about 21~22 mm in height, about 12.75~13.3 mm in diameter and having an undercut head with a small cylindrical cavity of about 12~13 mm in length dug, drilled or formed inside the center of a lower portion of the cylindrical object, the cavity being matched directly with the small cylindrical shaped object of the outer most part of said shaft and firmly adhered thereto by adhesive.

* * * * *